US005774912A

United States Patent [19]

Dominique

[11] Patent Number: 5,774,912

[45] Date of Patent: Jul. 7, 1998

[54] TOWEL WITH CARRYING POCKET

[76] Inventor: Bernard Dominique, 4480, Côte-de-Liesse, bureau 224, Ville Mont-Royal (QC), Canada, H4N 2R1

[21] Appl. No.: 784,355

[22] Filed: Jan. 23, 1997

[51] Int. Cl.[6] ..... A47G 9/06

[52] U.S. Cl. ..... 5/419; 5/417; 5/922

[58] Field of Search ..... 5/417–420, 922; 428/81

[56] References Cited

U.S. PATENT DOCUMENTS

| | | | |
|---|---|---|---|
| D. 322,532 | 12/1991 | Kumar et al. | D6/596 |
| D. 360,797 | 8/1995 | Evans | 5/417 |
| 4,231,125 | 11/1980 | Tittl | 5/419 |
| 4,634,618 | 1/1987 | Greer et al. | 5/417 |
| 5,072,467 | 12/1991 | Hunt | 5/419 |
| 5,261,131 | 11/1993 | Kilby | 5/419 |
| 5,361,435 | 11/1994 | Reeves | 5/419 |
| 5,390,381 | 2/1995 | La Mantia | 5/417 |
| 5,457,829 | 10/1995 | Elliott | 5/420 |

*Primary Examiner*—Alexander Grosz

[57] ABSTRACT

A portable towel having a rectangular sheet and a relatively smaller head piece. The head piece has a two layer section, forming a pocket with an openmouth, extending from a one layer section attached to the top edge of the sheet and to the inside of the pocket. In its folded state, the rectangular sheet is folded up and rolled inside of the pocket along with the one layer section of the head piece. The pocket is therefore being closed at its openmouth and carried over with a belt like handling feature. With the sheet being in its unfolded state, the pocket may be filled with any type of clothing articles to form a pillow or the like attached to the sheet. Also, the towel has a few pouches that can be filled with weights such as sand to hold it in place on the ground.

15 Claims, 6 Drawing Sheets

TOWEL WITH CARRYING POCKET

FIELD OF THE INVENTION

This invention relates to the field of towels, particularly those pertaining to portability.

BACKGROUND OF THE INVENTION

A variety of towel devices comprising different built-in features such as head rest means or pocket like means can be found in the relevant art as found in U.S. Pat. Nos. 5,457,829 to Elliott on Oct. 17, 1995; 5,390,381 to LaMantia on Feb. 21, 1995; 5,361,435 to Reeves on Nov. 8, 1994; 5,261,131 to Kilby on Nov. 16, 1993; 5,072,467 to Hunt on Dec. 17, 1991; 4,634,618 to Greer on Jan. 6, 1987; 4,231,125 to Tittl on Nov. 4, 1980; Des 360,797 to Evans on Aug. 1, 1995; and Des 322,532 to Kumar on Dec. 24, 1991. All these devices generally consider a standard pocket to be filled with a pillow or the like to form a head rest when the towel is in the unfolded state. Some of the devices have a sort of pocket located on the back of the towel, which is not always convenient when the towel user needs to access it. Such a pocket may also be uncomfortable for the user if there is either a carrying feature or a fastening means attached to it. Some other devices have a head rest means adjacent to the top edge of the towel to serve as a pillow, but none of the devices shows a pocket with a fastening means and a carrying means that can form a closed bag which can be easily carried by the user and containing the towel.

It is an object of the present invention to provide a towel to allow the user full enjoyment of his leisure time while avoiding all the petty inconveniences that come with the beach, the pool, or any other leisure site. The towel is composed of a plush like material fabric. A head piece made out of sheer like fabric is attached to one of the ends to accommodate the user's head. The head piece has a hook and loop type of releasable tape, such as Velcro (a trademark), used to close its opening either when the towel is folded in or when some clothing articles are inserted in to form a pillow or the like. It also has a carrying means attached to it.

It is a further object of the present invention to provide a towel that is of ease of transport. The user has only to fold his towel, place it in the pocket, strap the belt around his waist and leave, unencumbered with free hands.

To improve the long use duration of the towel, it may be composed of two layers: a plush upper side for the comfort of the user and a sheer back side designed for contact with the ground. At each corner there is a pouch in which one may place items or sand as weights to keep the towel in place.

SUMMARY OF THE INVENTION

According to one aspect of the present invention, there is provided a towel which comprises:

a substantially rectangular single layer sheet having a top edge, a bottom edge, a right and a left edges;

a relatively smaller head piece having a two layer section extending from a one layer section, the two layer section forms a pocket with an openmouth oriented towards the rectangular sheet. The one layer section is attached at a first end to the top edge of the rectangular sheet through an attachment means and is permanently attached at a second end internally to the pocket. The head piece is centered with respect to the top edge. The pocket has a releasable fastening means at the openmouth and is adapted to contain the rectangular sheet and the one layer section of the head piece to form the towel in a folded state. The pocket is also adapted to form a pillow or the like when the towel is in an unfolded state.

With another aspect of the present invention, there is also provided a towel which further comprises a carrying means attached to the pocket and used to carry the pocket when the towel is in said folded state.

With another aspect of the present invention, there is also provided a towel which further comprises a plurality of small sewn pouches located on the periphery of the first layer of the rectangular sheet. The pouches are used as small pockets for weights.

According to a further aspect of the present invention, there is provided a towel wherein the rectangular sheet further comprises a second layer being used as a groundsheet. The second layer is substantially of the same size as the first layer and is sewn to the first layer all along its periphery.

BRIEF DESCRIPTION OF THE DRAWINGS

We will next describe the preferred embodiment of the above-mentioned invention in full detail and with reference to accompanying drawings, of which.

DETAILED DESCRIPTION OF THE PREFERRED EMBODIMENT

Figure 1:
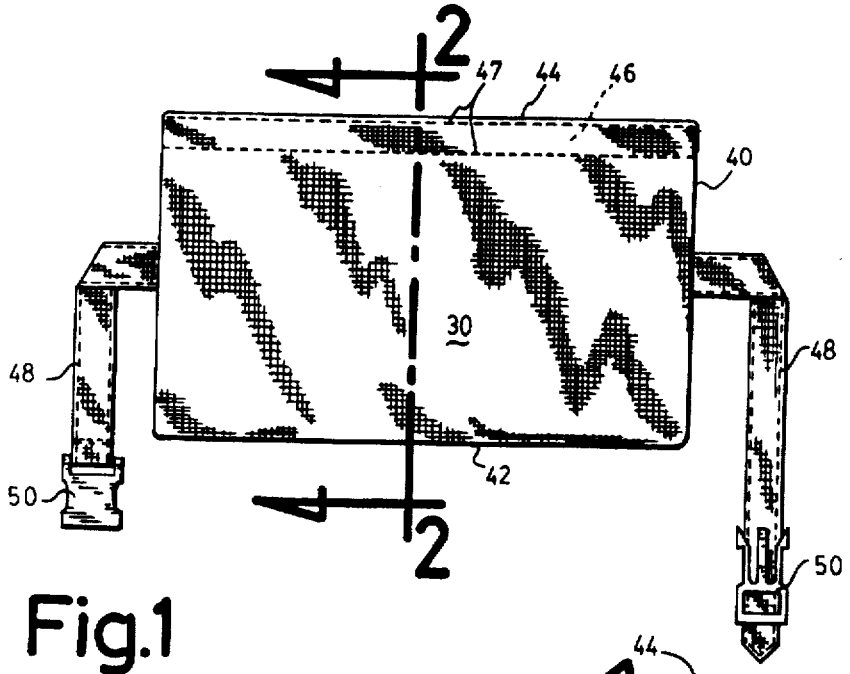
FIG. 1 is a plan view of the preferred embodiment in its folded state.

The preferred embodiment of the invention is illustrated in FIG. 1 where the various elements are identified by their numbers and we see:

A portable towel 40, preferably a beach towel, in its folded state 30 which comprises a two layer section piece forming a pocket 42, preferably rectangular, closed at its openmouth 44 with a fastening means, preferably a hook and loop type of releasable tape 46 stitched to the pocket 42; stitches 47 are shown in dotted lines. A carrying means, preferably a belt 48 with a buckle 50, is permanently attached to the pocket 42 to allow a user to carry the towel around its waist.

Figure 3:
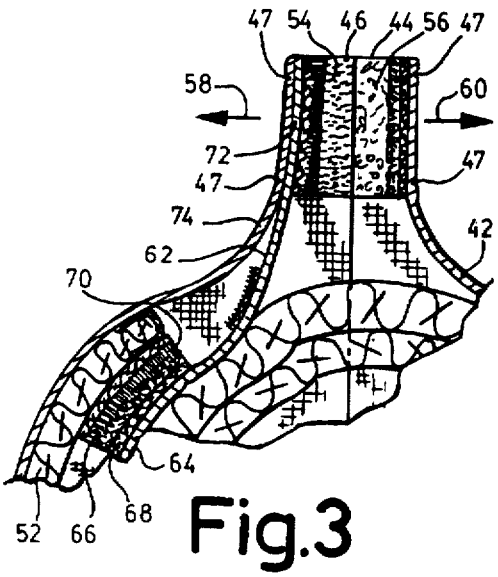
FIG. 3 is an enlarged view along line 3 of FIG. 2.
Figure 2:
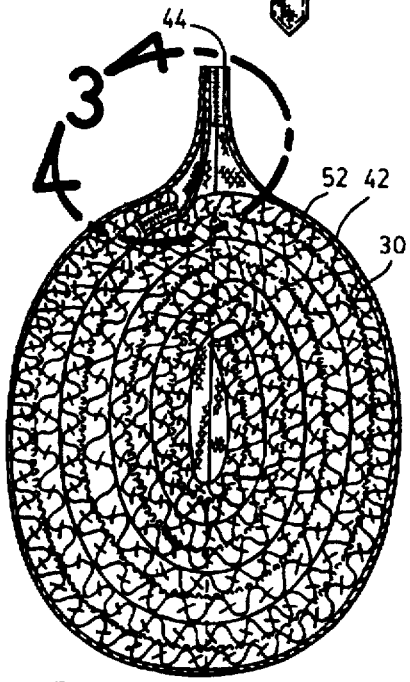
FIG. 2 is a section view along line 2—2 of FIG. 1.

FIG. 2 shows the inside of the pocket 42 with the substantially rectangular single layer sheet 52 rolled in its folded state 30. A detailed representation of the openmouth 44 shown in FIG. 3 shows the hook 54 and loop 56 type of tape 46 which is released by displacing the hook 54 and the loop 56 in the direction of the arrows 58 and 60 respectively. The sheet 52 is linked to the pocket 42 by a one layer section piece 62 which is attached at a first end 64 to the sheet 52 via an attachment means, preferably a hook 66 and loop 68 type of tape 70, and permanently attached at a second end 72 internally to the pocket 42, preferably at the openmouth 44, via the stitches 47. The two layer section, or the pocket 42, and the one layer section 62 form a head piece 74 attached to the sheet 52 via the hook 66 and loop 68 type of tape 70 attachment means.

Figure 4:
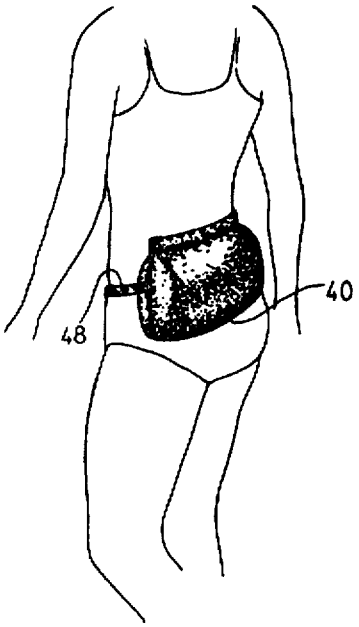
FIG. 4 and FIG. 5 are perspective views showing different ways of carrying the preferred embodiment.
Figure 5:
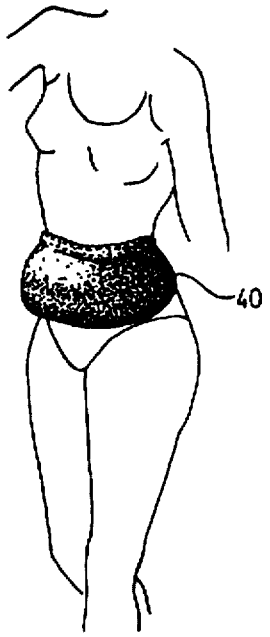
Figure 6:
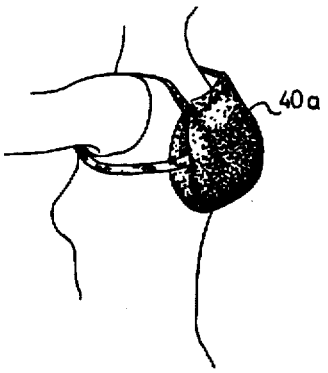
FIG. 6 and FIG. 7 are perspective views showing different ways of carrying other embodiments.
Figure 7:
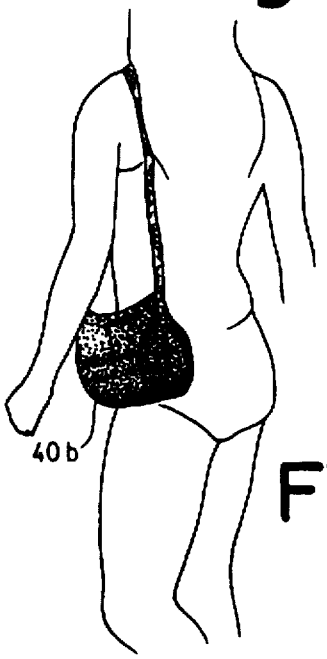

FIG. 4 and FIG. 5 show the towel 40 being carried around a user's waist with the belt 48, leaving the user's hands free to do something else in the mean time. FIG. 6 and FIG. 7 show different embodiments of the towel 40*a*, 40*b* with respect to the carrying means.

Figure 8:
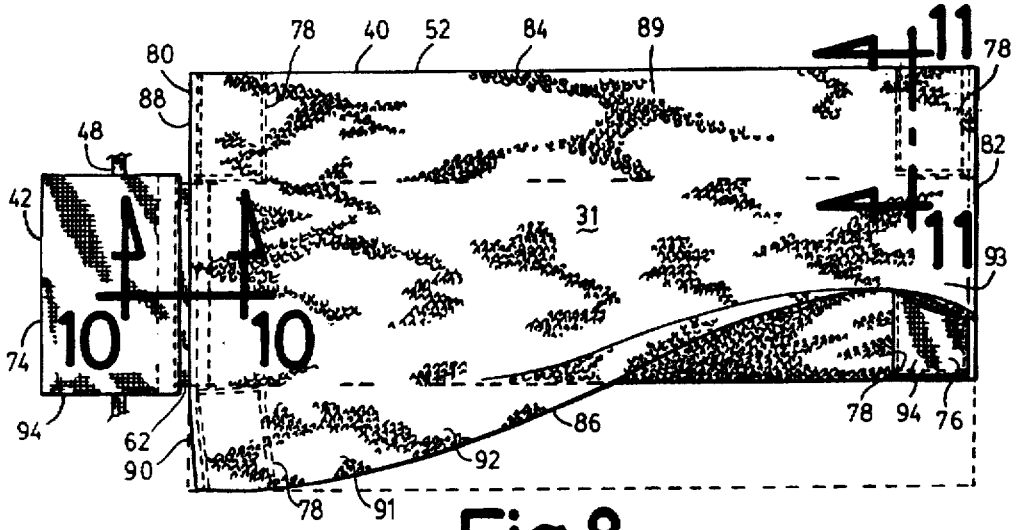
FIG. 8 is an elevation view of the preferred embodiment in its almost totally unfolded state.

The portable towel 40 in its unfolded state 31 is represented in FIG. 8 with the rectangular sheet 52, the head piece 74 and the belt 48 carrying means. The sheet 52 has a top edge 80, a bottom edge 82, a right 84 and left 86 edges. The head piece 74 is smaller than the top edge 80 and centered with respect to it, thus forming two shoulders 88, 90. The sheet 52 is preferably made out of a plush like fabric material 92. The sheet 52 is partially folded to show the location of one of a plurality small pouches 76 at the back, preferably at the four corners, of the sheet 52 and attached via stitches 78. The head piece 74 as well as the small pouches 76 are preferably made out of resistant sheer like fabric material 94. The two shoulders 88, 90 form two narrow bands 89, 91 respectively along the right and left edges 84, 86 of the sheet 52. To get the towel 40 in its folded state 30 (see FIG. 1 and FIG. 2), these two bands 89, 91 are folded over towards each other then, the narrow rectangle 93 formed thereof is rolled starting from the bottom edge 82 up to the top edge 80 before going into the pocket 42 via its openmouth 44 along with the one side section 62.

Figure 9:
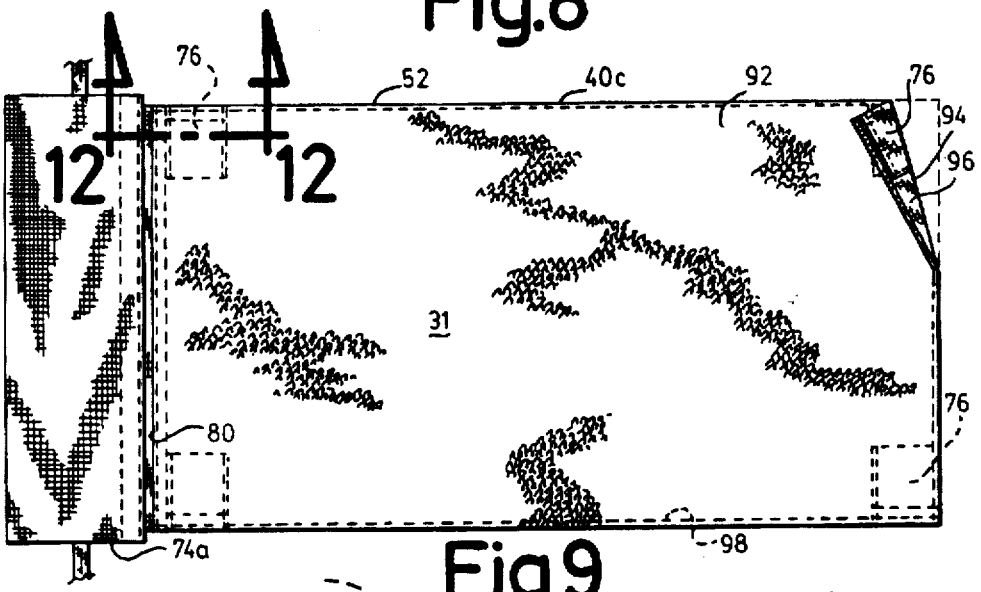
FIG. 9 is an elevation view of another embodiment.

FIG. 9 shows a different embodiment of the towel 40*c* with respect to both the size of the head piece 74*a* which has the same length as the top edge 80 of the sheet 52 and the addition of a second layer 96, made out of sheer like fabric material 94, on the sheet 52. That second layer 96 is substantially of the same size as the first layer and is attached to the back of the first layer via stitches 98 located all around its periphery. This second layer 96 is mainly used as a groundsheet to prevent the first plush layer from being damaged from any imperfection that might be on the ground 106.

Figure 10:
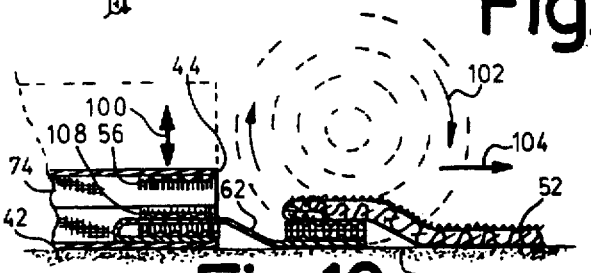
FIG. 10 is an enlarged section view along line 10—10 of FIG. 8.

An enlarged section view of the interface between the sheet 52 and the head piece 74 is shown in FIG. 10. The openmouth 44 of the pocket 42 opens in the direction 100 such that the sheet 52 comes out of the pocket 42 with the one layer section 62 of the head piece 74. The sheet 52 unfolds 102 in the direction 104 in order to lay on the ground 106. To use the pocket 42 as a head rest means for the user, it is possible to fill it in with some clothing articles or the like and then close it using a hook type strip 108 provided on the one layer section 62 that fastened to the loop type strip 56 of the tape 46.

Figure 11:
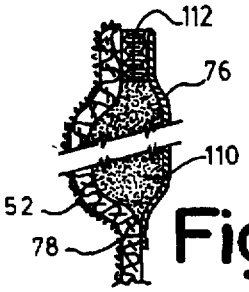
FIG. 11 is an enlarged section view along line 11—11 of FIG. 8.

FIG. 11 represents a small pouch 76 attached to the back of the sheet 52 and filled with any weight material, preferably sand 110, used to hold the towel down on the ground. The small pouch 76 is attached to the sheet 52 with stitches 78, with an opening which can preferably be closed with another hook and look type of tape 112 to entrap the weight material 110 in.

Figure 12:
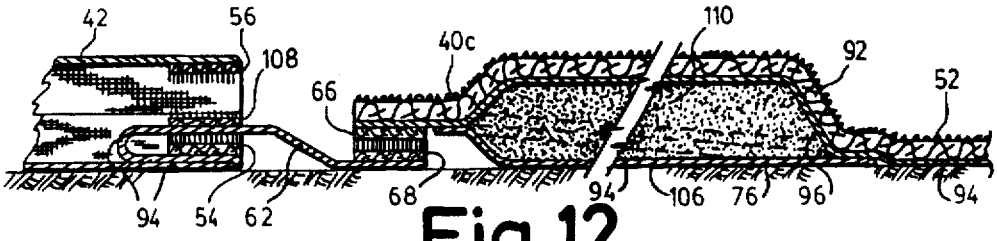
FIG. 12 is an enlarged section view along line 12—12 of FIG. 9.

The towel 40*c* is partially represented in FIG. 12 in its unfolded state laying on the ground 106. One of the small pouches 76 attached to the back of the second layer 96 of the sheet 52 is filled with sand 110. The one layer section 62 and the two layer section, the pocket 42, are also shown here with the possibility of closing the pocket openmouth 44 with the hook type strip 108 to form a pillow or the like. The small pouches 76, the one layer section 62 and the pocket 42 are also preferably made out of a sheer like fabric material 94.

Figure 13:
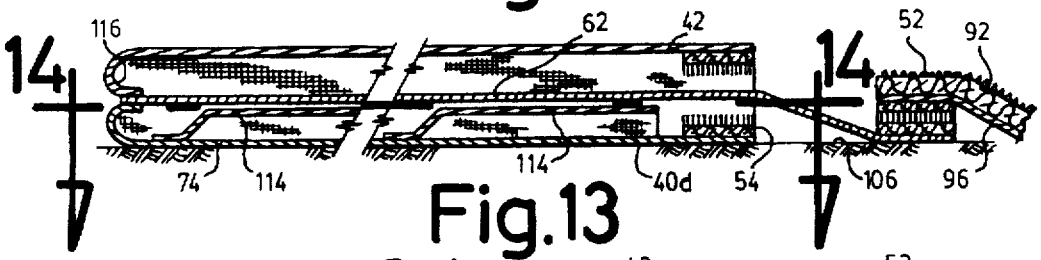
FIG. 13 is a cross-section view of a head piece of another embodiment.
Figure 14:
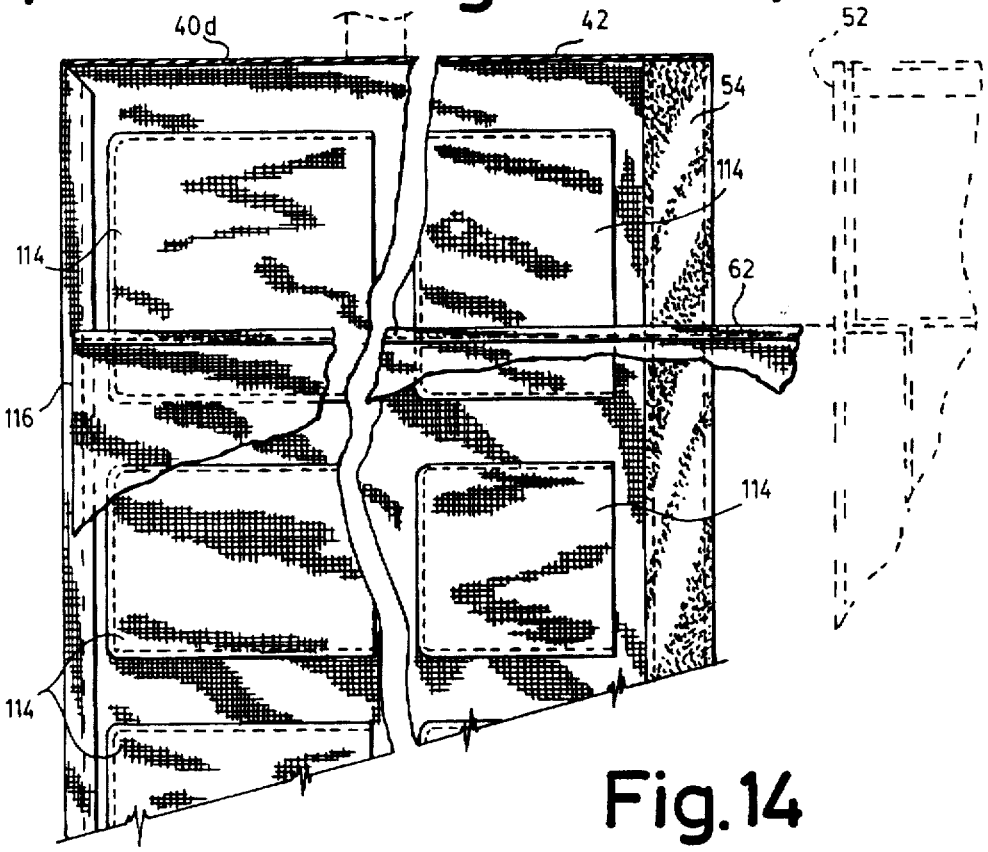
FIG. 14 is a section view along line 14—14 of FIG. 13.
Figure 16:
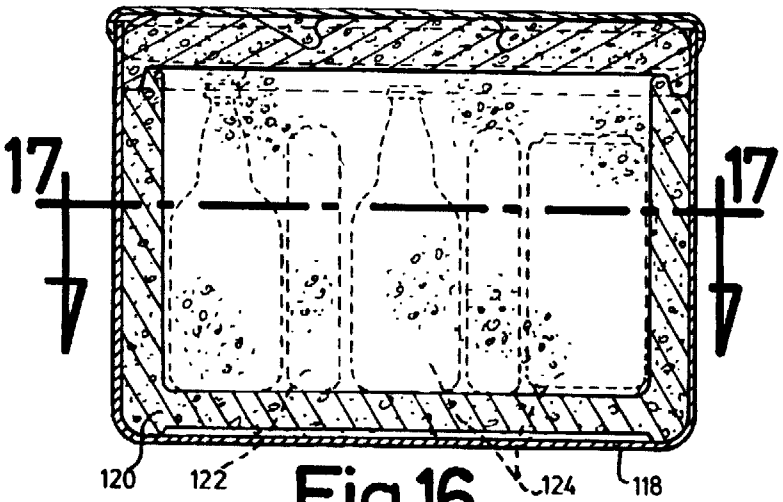
FIG. 16 is a section view along line 16—16 of FIG. 15.
Figure 17:
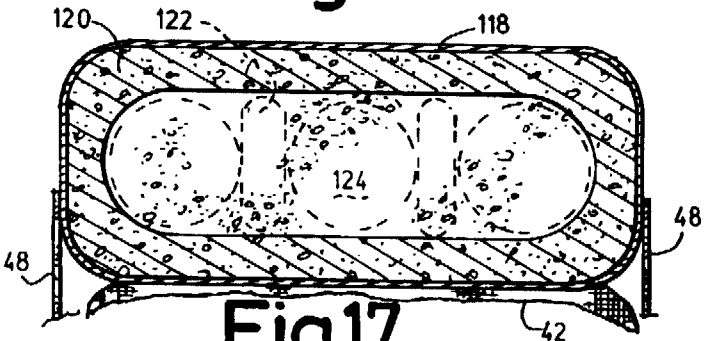
FIG. 17 is a section view along line 17—17 of FIG. 16.
Figure 15:
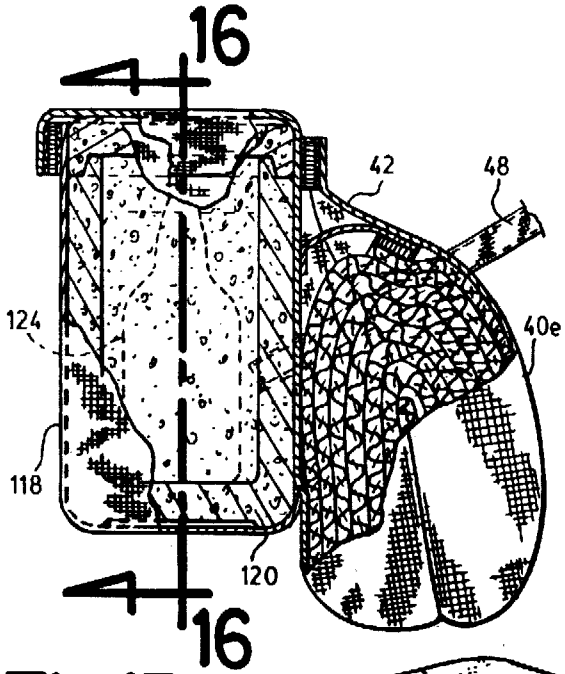
FIG. 15 is an opened side view of another embodiment in its folded state attached to a portable cooler container.
Figure 18:
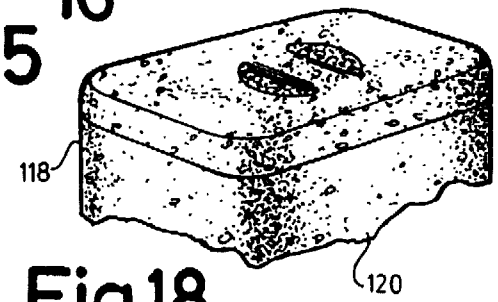
FIG. 18 is a partial top perspective view of the cooler container.

FIG. 13 and 14 represent another embodiment of the towel 40*d* which has a plurality of additional small internal pockets 114 inside to the pocket 42 of the head piece 74. These small internal pockets 114 are preferably used for storing and carrying different valuables, any small articles such body lotions or the like. This embodiment also has a one layer section 62 attached internally to the bottom 116 of the pocket 42.

A different embodiment of the towel 40*e* with respect to the carrying means which is a belt 48 attached to a cooler container 118 is shown in FIG. 15 to 18. The cooler container 118 mainly comprises a thermally insulating box 120 or the like which contains cool and refreshing food 122 and beverages 124.

Figure 19:
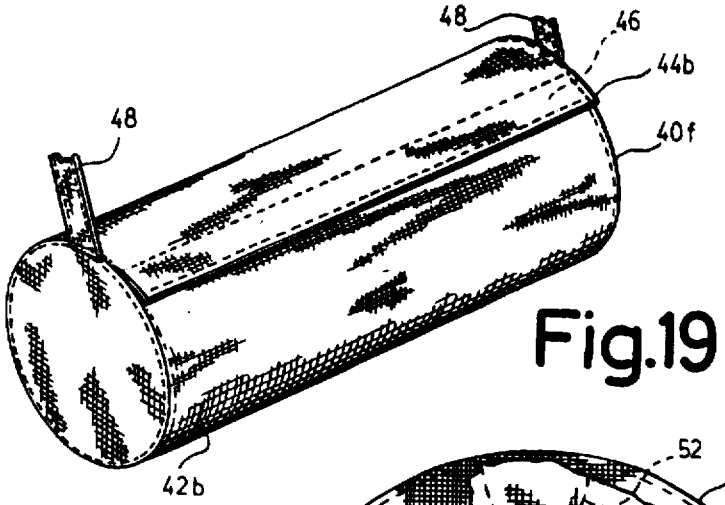
FIG. 19 is a perspective view of another embodiment in its folded state.

FIG. 19 shows another embodiment of the towel 40*f* in its folded state with a different cylindrical shape pocket 42*b* and a modified openmouth 44*b* also preferably fastened by a hook and loop type of releasable tape 46.

Figure 20:
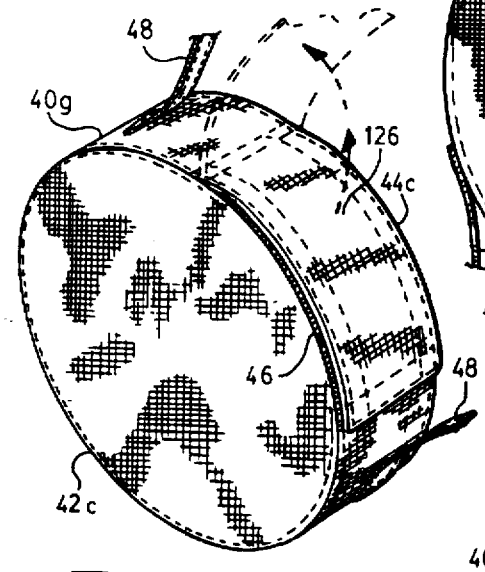
FIG. 20 is a perspective view of another embodiment in its folded state.

FIG. 20 also shows another embodiment of the towel 40*g* in its folded state with a different wheel shape pocket 42*c* and a modified openmouth 44*c* being a flap like type opening 126 moving as shown and, also preferably fastened by a hook and loop type of releasable tape 46.

Figure 21:
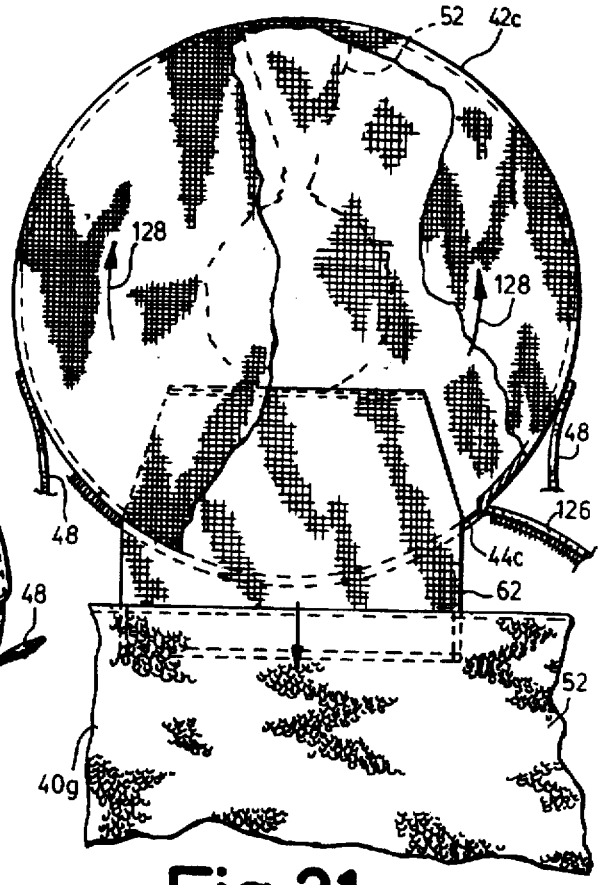
FIG. 21 is a partial elevation view of another embodiment in its unfolded state.

The towel 40*g* is represented, in FIG. 21, in its unfolded state with the sheet 52 and the one layer section 62 coming out of the pocket 42*c* through the opened openmouth 44*c*. The rolled sheet 52 is also shown when it is folded inside the pocket 42*c* into a donut like shape 128, as represented in dotted lines.

It will be understood that the above described embodiment is for purposes of illustration only and that changes and modifications may be made thereto without departing from the spirit and scope of the present invention.

Other uses are possible and limited only by the extension of claims which follow:

I claim:

1. A towel comprising:

a substantially rectangular single layer sheet having a top edge, a bottom edge, a right and a left edges;

a relatively smaller head piece having a two layer section extending from a one layer section, said two layer section forming a pocket with an openmouth oriented towards said rectangular sheet, said one layer section being attached at a first end to said top edge of said rectangular sheet through an attachment means and being permanently attached at a second end internally to said pocket, said head piece being centered with respect to said top edge, said pocket having a releasable fastening means at said openmouth and being adapted to contain said rectangular sheet and said one layer section of said head piece to form said towel in a folded state, said pocket being also adapted to form a pillow when said towel is in an unfolded state.

2. A towel as defined in claim 1 further comprising a carrying means attached to said pocket and used to carry said pocket when said towel is in said folded state.

3. A towel as defined in claim 1 wherein said head piece is narrower than said top edge.

4. A towel as defined in claim 1 wherein said head piece is of the same length as said top edge.

5. A towel as defined in claim 1 further comprising a plurality of small sewn pouches located on the periphery of said first layer of said rectangular sheet, said pouches being used as small pockets for weights.

6. A towel as defined in claim 1 wherein both said attachment means and said fastening means are hook and loop type releasable tapes.

7. A towel as defined in claim 1 wherein said pocket further comprises a plurality of small internal pockets for storing and carrying small articles.

8. A towel as defined in claim 1 wherein said rectangular sheet further comprises a second layer being used as a groundsheet, said second layer being substantially of the same size as said first layer and being sewn to said first layer all along its periphery.

9. A towel as defined in claim 8 further comprising a carrying means attached to said pocket and used to carry said pocket when said towel is in said folded state.

10. A towel as defined in claim 9 wherein said carrying means is a belt with a buckle, said first layer of said sheet is made out of plush like fabric material, said second layer of said sheet is made out of sheer like fabric material.

11. A towel as defined in claim 9 wherein said carrying means is a small portable cooler container.

12. A towel as defined in claim 8 further comprising a plurality of small sewn pouches located on said periphery of said second layer of said rectangular sheet, said pouches being used as small pockets for weights.

13. A towel as defined in claim 8 wherein both said attachment means and said fastening means being hook and loop type releasable tapes.

14. A towel as defined in claim 8 wherein said one layer section of said head piece is an extension of said second layer of said rectangular sheet.

15. A towel as defined in claim 14 wherein said second layer of said rectangular sheet is a polyamide type of material.

* * * * *